US012302942B2

(12) United States Patent
Kwon et al.

(10) Patent No.: US 12,302,942 B2
(45) Date of Patent: May 20, 2025

(54) AEROSOL GENERATING ARTICLES COMPRISING ORGANIC ACIDS

(71) Applicant: KT&G CORPORATION, Daejeon (KR)

(72) Inventors: Chan Min Kwon, Daejeon (KR); Tae Kyung Lee, Daejeon (KR); Sun Hwan Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 559 days.

(21) Appl. No.: 17/597,440

(22) PCT Filed: Sep. 9, 2021

(86) PCT No.: PCT/KR2021/012291
§ 371 (c)(1),
(2) Date: Jan. 6, 2022

(87) PCT Pub. No.: WO2022/085942
PCT Pub. Date: Apr. 28, 2022

(65) Prior Publication Data

US 2023/0263211 A1 Aug. 24, 2023

(30) Foreign Application Priority Data

Oct. 19, 2020 (KR) ..... 10-2020-0135519

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24B 15/283* (2013.01); *A24B 15/32* (2013.01);
(Continued)

(58) Field of Classification Search
None
See application file for complete search history.

(56) References Cited

U.S. PATENT DOCUMENTS 9,215,895 B2 12/2015 Bowen et al.
9,380,810 B2 7/2016 Rose et al.
(Continued)

FOREIGN PATENT DOCUMENTS

CA 2 774 264 A1 3/2011
CA 3 133 014 A1 9/2020
(Continued)

OTHER PUBLICATIONS

Japanese Office Action dated Feb. 21, 2023 in Japanese Application No. 2021-576160.
(Continued)

*Primary Examiner* — Katherine A Will
(74) *Attorney, Agent, or Firm* — Sughrue Mion, PLLC

(57) ABSTRACT

An aerosol generating article includes a first portion including an organic acid, a second portion including a nicotine freebase, a third portion including a cooling material, and a fourth portion including a filter material, wherein a nicotine salt is generated through an acid-base reaction of the organic acid and nicotine freebase that are vaporized by heating.

12 Claims, 4 Drawing Sheets

(51) Int. Cl.

| | |
|---|---|
| ***A24B 15/28*** | (2006.01) |
| ***A24B 15/32*** | (2006.01) |
| ***A24B 15/38*** | (2006.01) |
| ***A24D 1/00*** | (2020.01) |
| ***A24D 1/02*** | (2006.01) |
| ***A24D 1/04*** | (2006.01) |
| ***A24F 40/20*** | (2020.01) |
| ***A24F 40/465*** | (2020.01) |

(52) U.S. Cl.

CPC ..... *A24B 15/385* (2013.01); *A24D 1/002* (2013.01); *A24D 1/02* (2013.01); *A24D 1/045* (2013.01); *A24F 40/20* (2020.01); *A24F 40/465* (2020.01)

(56) References Cited

U.S. PATENT DOCUMENTS

| | | | | |
|---|---|---|---|---|
| 9,974,329 | B2 | 5/2018 | Buehler et al. | |
| 10,076,140 | B2 | 9/2018 | Silvestrini | |
| 10,485,261 | B2 | 11/2019 | Schaller | |
| 11,013,872 | B2 | 5/2021 | Silvestrini et al. | |
| 11,154,668 | B2 | 10/2021 | Besso et al. | |
| 11,178,906 | B2 | 11/2021 | Lang et al. | |
| 2016/0022930 | A1 | 1/2016 | Greim et al. | |
| 2016/0295926 | A1 | 10/2016 | Zuber | |
| 2017/0055581 | A1 | 3/2017 | Wilke et al. | |
| 2017/0071250 | A1* | 3/2017 | Mironov | A24F 40/465 |
| 2017/0303581 | A1 | 10/2017 | Schaller | |
| 2019/0124982 | A1 | 5/2019 | Atkins et al. | |
| 2019/0200669 | A1 | 7/2019 | Lang et al. | |
| 2020/0359688 | A1 | 11/2020 | Jang et al. | |
| 2020/0384221 | A1 | 12/2020 | Lang | |
| 2023/0172264 | A1* | 6/2023 | Tesfatsion | A24D 1/20 131/328 |
| 2024/0389643 | A1 | 11/2024 | Park et al. | |

FOREIGN PATENT DOCUMENTS

| | | | |
|---|---|---|---|
| CN | 106686991 | A | 5/2017 |
| CN | 109430943 | A | 3/2019 |
| CN | 109497622 | A | 3/2019 |
| CN | 107072296 | B | 8/2020 |
| EP | 3 334 299 | B1 | 10/2019 |
| JP | 2017-528153 | A | 9/2017 |
| JP | 2019-528054 | A | 10/2019 |
| KR | 10-1432877 | B1 | 9/2014 |
| KR | 10-2016-0004298 | A | 1/2016 |
| KR | 10-2016-0098212 | A | 8/2016 |
| KR | 10-2016-0145838 | A | 12/2016 |
| KR | 10-2017-0110592 | A | 10/2017 |
| KR | 10-2019-0035725 | A | 4/2019 |
| KR | 10-2019-0093027 | A | 8/2019 |
| KR | 10-2019-0134855 | A | 12/2019 |
| KR | 10-2020-0098515 | A | 8/2020 |
| WO | 2017/118553 | A1 | 7/2017 |
| WO | 2019/238704 | A1 | 12/2019 |
| WO | 2020/091394 | A1 | 5/2020 |

OTHER PUBLICATIONS

Extended European Search Report dated Aug. 23, 2022, issued in European Application No. 21834700.3.

International Search Report dated Jan. 12, 2022 in Application No. PCT/KR2021/012291.

Office Action issued Dec. 1, 2022 in Korean Application No. 10-2020-0135519.

Office Action issued Mar. 24, 2025 in Chinese Patent Application No. 202180004978.3.

* cited by examiner

AEROSOL GENERATING ARTICLES COMPRISING ORGANIC ACIDS

CROSS REFERENCE TO RELATED APPLICATIONS

This application is a National Stage of International Application No. PCT/KR2021/012291 filed Sep. 9, 2021, claiming priority based on Korean Patent Application No. 10-2020-0135519 filed Oct. 19, 2020.

TECHNICAL FIELD

The present disclosure relates to an aerosol generating article including an organic acid.

BACKGROUND ART

Recently, the demand for alternative methods to overcome the disadvantages of traditional aerosol generating articles has increased. For example, there is growing demand for an aerosol generating device which generates aerosol by heating an aerosol generating material in cigarettes, rather than by combusting cigarettes.

DESCRIPTION OF EMBODIMENTS

Technical Problem

The present disclosure provides an aerosol generating article including a nicotine freebase and an organic acid in different portions thereof. Accordingly, a nicotine salt is generated in an airflow generated by inhalations of a user by a reaction of the nicotine freebase and organic acids when the aerosol generating article is heated and an aerosol may be generated due to heating of the generated nicotine salt at a low temperature.

The problems to be solved by the embodiments are not limited to the above-described problems, and undescribed problems may be clearly understood by those skilled in the art to which the present disclosure belongs from the present specification and the accompanying drawings.

Solution to Problem

According to a first aspect of the present disclosure, an aerosol generating article includes a first portion including an organic acid, a second portion including a nicotine freebase, a third portion including a cooling material, and a fourth portion including a filter material, wherein a nicotine salt is generated through a acid-base reaction of the organic acid and nicotine freebase that are vaporized by heating.

According to a second aspect of the present disclosure, an aerosol generating system includes the aerosol generating article of the first aspect and an aerosol generating device, and the aerosol generating device includes an accommodating space accommodating the aerosol generating article, a heating element for heating the aerosol generating article, a processor for controlling an operation of the heating element, and a battery for supplying power to the processor and the heating element.

However, the solutions to the technical problem are not limited to the above, and the present disclosure may include all solutions that may be inferred by one of ordinary skill in the art throughout the specification.

Advantageous Effects of Disclosure

According to an aerosol generating article according to the present disclosure, because nicotine salt is generated through a chemical reaction between a nicotine freebase and an organic acid that have relatively low boiling points compared to nicotine salt, nicotine salt may be generated by heating the aerosol generating article at a relatively low temperature compared to aerosol generating articles including nicotine salt.

As heating in a relatively low temperature becomes possible, power consumption of a battery may be reduced, thereby allowing long term use of an aerosol generating device and reducing the size of the battery and reducing the possibility of generating pyrolysis materials and off-flavors caused by heating at a high temperature.

Further, by strengthening the effect of transferring organic acids, the nicotine transfer amount of the aerosol generating article may be improved.

In addition, because the user may inhale nicotine in a nicotine salt form instead of a nicotine freebase form, satisfaction of a user may be increased.

However, the effects of the present disclosure are not limited to the above-described effects, and the present disclosure may include all effects that can be inferred from the specification and the drawings.

BEST MODE

Figure 1:
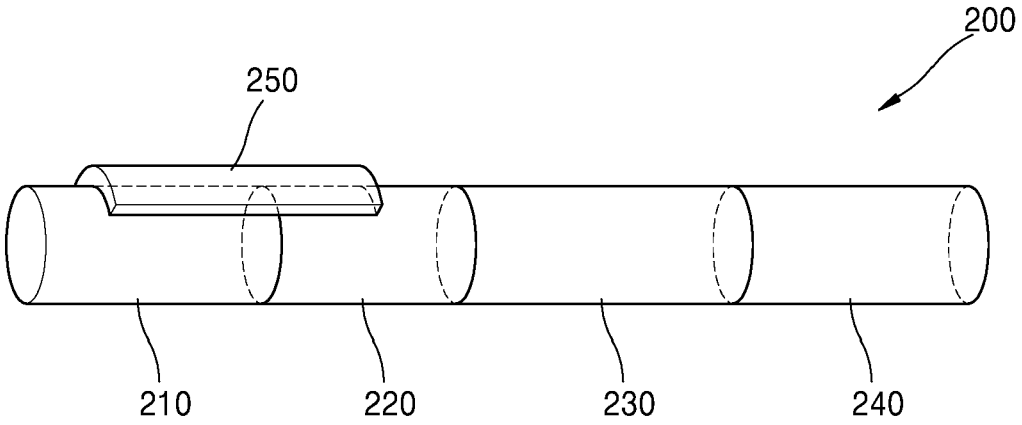
FIG. 1 is a brief view of a configuration of an aerosol generating article according to an embodiment.

An aerosol generating article according to one or more embodiments includes: a first portion including an organic acid; a second portion including a nicotine freebase; a third portion including a cooling material; and a fourth portion including a filter material, wherein nicotine salt is generated through acid-base reaction of the organic acid and the nicotine freebase, both vaporized by heating.

According to an embodiment, the first portion, the second portion, the third portion, and the fourth portion may be arranged sequentially in a longitudinal direction of the aerosol generating article.

According to an embodiment, the first portion and the second portion may be positioned in parallel, and the third portion and the fourth portion may be arranged sequentially in a longitudinal direction of the aerosol generating article.

According to an embodiment, the third portion may include an acid-base reaction space.

According to an embodiment, the third portion may include an absorbent material.

According to an embodiment, at least one of the organic acid and the nicotine freebase may be included in a capsule crushable by external force and/or heat.

According to an embodiment, at least one of the first and second portions may include a moisturizer.

According to an embodiment, the moisturizer may include both propylene glycol and glycerin.

According to an embodiment, the aerosol generating article may further include a material for heating, wherein the material for heating may include a metal wrapper surrounding at least part of at least one of the first portion and the second portion, and may be heated to transfer heat to the organic acid and the nicotine salt.

According to an embodiment, the material for heating may surround at least part of the first portion and at least part of the second portion and bind the first portion to the second portion.

According to an embodiment, the material for heating may be heated by a variable magnetic field.

An aerosol generating system according to one or more embodiments includes: an aerosol generating article; and an aerosol generating device, and the aerosol generating device includes: an accommodating space accommodating the aerosol generating article; a heating element for heating the aerosol generating article; a processor for controlling an operation of the heating element; and a battery for supplying power to the processor and the heating element.

According to an embodiment, an aerosol generating article may further include a material for heating, and the heating element may form a variable magnetic field to heat the material for heating.

MODE OF DISCLOSURE

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. Also, in a special case, there may be terms that are arbitrarily selected by the applicant. In this case, the meanings of the terms will be described in detail in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

Hereinafter, embodiments of the present disclosure will be described in detail with reference to the accompanying drawings so that those of ordinary skill in the art may easily implement the embodiments. However, the present disclosure may be implemented in various different forms and is not limited to the embodiments described herein.

In addition, terms including ordinal numbers such as "first" or "second" used in the present specification may be used to describe various components, but the components should not be limited by the terms. Terms are used only for the purpose of distinguishing one component from another component.

In addition, some components in the drawings may be illustrated to be somewhat exaggerated in size or ratio.

Throughout the specification, "upstream" and "downstream" may be determined based on the direction of air flowing when a user is smoking using an aerosol generating article. For example, when the user smokes using the aerosol generating article shown in FIG. 1, because an aerosol generated from the first portion 210 or the second portion 220 may be transferred along air introduced from the outside sequentially to the third portion 230 and the fourth portion 240, and then to the user, the first portion 210 is positioned upstream relative to the fourth portion 240. However, it may be understood by one of ordinary skill in the art that "upstream" and "downstream" may be relative according to the relation between components.

Further, throughout the specification, a "longitudinal direction" may mean a direction from an upstream end toward a downstream end or an opposite direction. For example, assuming that the aerosol generating article is located in the first portion 210, the second portion 220, the third portion 230, and the fourth portion 240, the longitudinal direction may be a direction from the first portion 210 toward the fourth portion 240 or an opposite direction.

Hereinafter, embodiments of the present disclosure will be described in detail with reference to the drawings.

Figure 2:
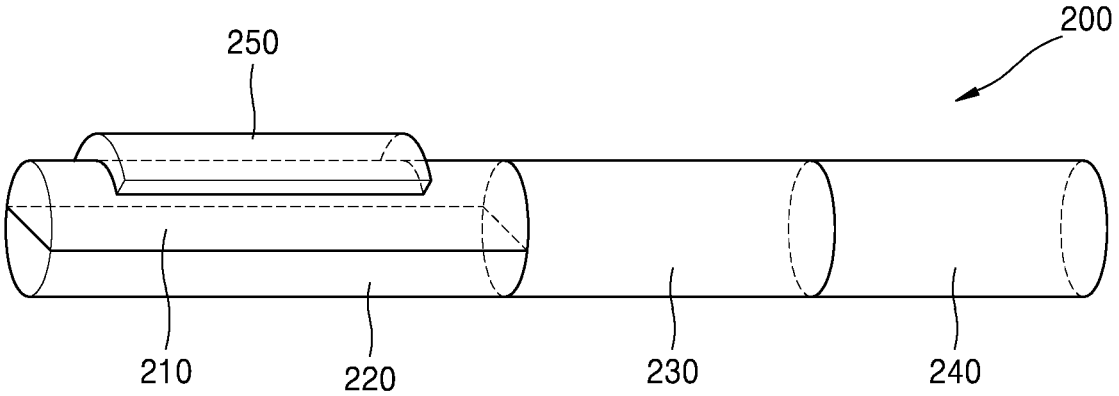
FIG. 2 is a brief view of a configuration of an aerosol generating article according to another embodiment.

FIG. 1 is a brief view of a configuration of an aerosol generating article according to an embodiment, and FIG. 2 is a brief view of a configuration of an aerosol generating article according to another embodiment.

Referring to FIG. 1, the first portion 210, the second portion 220, the third portion 230, and the fourth portion 240 may be arranged sequentially in a longitudinal direction of the aerosol generating article 200. Accordingly, vapor and/or an aerosol generated in at least one of the first portion 210 and the second portion 220 may sequentially pass through the first portion 210, the second portion 220, the third portion 230, and the fourth portion 240 to form an airflow, and thus, the user may inhale vapor and/or the aerosol from the fourth portion 240.

According to an embodiment, the first portion 210 may include an organic acid, the second portion 220 may include nicotine freebase, the third portion 230 may include a cooling material that cools an airflow passing through the first portion 210 and the second portion 220, and the fourth portion 240 may include a filter material.

The first portion 210 may include a crimped paper, and the organic acid may be impregnated with the crimped paper. As the first portion 210 is heated, heat may be transferred to the crimped paper containing the organic acid, and thus, the organic acid may be phase-changed to vapor or aerosol. An organic acid in a vapor or aerosol state may move from the downstream to the upstream of the aerosol generating article according to the inhalation of the user. The crimped paper may refer to a paper crumpled to be in a wrinkled shape by being passed through a roller with unevenness. Compared to a general paper, the crimped paper may be more easily compressed when manufacturing the aerosol generating article, and may have positive effects on contact areas with air and suction resistance.

Similar to the first portion 210, the second portion 220 may also include a crimped paper, and the nicotine freebase may be impregnated with the crimped paper. As the second portion 220 is heated, heat may be transferred to the crimped paper containing the nicotine freebase, and the nicotine freebase may be phase-changed to vapor or aerosol. Nicotine freebase in a vapor or aerosol state may progress from the upstream to the downstream of the aerosol generating article according to the inhalation of the user.

An organic acid may refer to an acid selected from pyruvic acid, lactic acid, acetic acid, formic acid, 3-methyl-2-oxovaleric acid, 2-oxovaleric acid, 4-methyl-2-oxovaleric acid, 3-methyl-2-oxobutanoic acid, 2-oxooctanoic acid, and 2-oxopropanoic acid, or a combination thereof, but is not limited thereto.

Nicotine freebase may refer to a neutral nicotine to which a proton is not added. For example, when a strong base such as ammonia (NH3) is added to a nicotine salt having a positive charge, the strong base is converted into a cation, and the nicotine salt may become a neutral nicotine freebase.

Since the nicotine freebase has a relatively low boiling point compared to the nicotine salt, it is possible to generate vapor even if the nicotine freebase is heated at a lower temperature compared to the nicotine salt. This may be particularly effective in an induction heating system that heats at a relatively low temperature. The relatively low temperature may be about 100° C. to about 300° C. Preferably, the relatively low temperature may be about 150° C. to about 200° C.

In addition, because the nicotine freebase is known to be relatively stimulative compared to the nicotine salt when inhaled by the user, the aerosol in the form of a nicotine freebase when vapor is generated and in the form of a nicotine salt when the user inhales may be appropriate in view of power efficiency and smoking satisfaction of the user.

The nicotine freebase and the nicotine salt according to an embodiment may have structures such as Formula 1 and Formula 2, respectively.

[Formula 1]

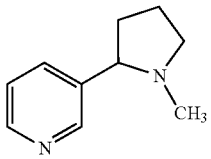

-continued

[Formula 2]

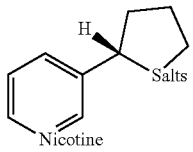

Organic acid vapor generated in the first portion 210 and nicotine freebase vapor generated in the second portion 220 may be mixed while moving along an airflow generated as the user inhales the aerosol generating article 200, and thus, an acid-base reaction may occur. Specifically, the acid-base reaction may occur at a first position in which organic acid vapor and nicotine freebase vapor meet, thereby generating the nicotine salt.

For example, the acid-base reaction may continuously occur from the upstream of the second portion 220 to the downstream of the fourth portion 240. Accordingly, the user may inhale nicotine in the form of a nicotine salt, not a nicotine freebase, and the smoking satisfaction may be improved.

Table 1 is an experimental data showing an average value of transfer amount of the nicotine and the organic acid transferred from the aerosol generating article according to the order of arrangement of a nicotine freebase sorption portion and an organic acid sorption portion. For example, experiment no. 1 is a case in which only nicotine freebase is sorbed, experiment no. 3 is a case in which nicotine freebase is sorbed upstream and organic acid is sorbed downstream, and experiment no. 4 is a case in which organic acid is sorbed upstream and nicotine freebase is sorbed downstream.

In Table 1, N may refer to nicotine freebase, P may refer to organic acid, RT may refer to room temperature, and N' may refer to nicotine salt. mg/CP, which is a transfer amount unit, may refer to a mass of the nicotine salt transferred per cigarette.

TABLE 1

| | | Upstream | | Downstream | | Transfer amount average (mg/CP) | | |
|---|---|---|---|---|---|---|---|---|
| | | Sorption | | Sorption | | | | |
| Classification | | amount (μl) | Temperature (° C.) | amount (μl) | Temperature (° C.) | Nicotine salt | Organic acid | Remark |
| 1 | N | 20 | RT | — | | 0.06 | — | — |
| 2 | P | 20 | RT | — | | — | 0.40 | — |
| 3 | N→P | 20 | RT | 20 | RT | 0.06 | 0.66 | P transfer amount ↑ |
| 4 | P→N | 20 | RT | 20 | RT | 0.19 | 0.40 | N' transfer amount ↑ |
| 5 | N→N | 20 | RT | 20 | RT | 0.07 | — | No change |
| 6 | N | 20 | 40 | — | | 0.17 | — | — |
| 7 | N→P | 20 | 40 | 20 | RT | 0.18 | 1.23 | P transfer amount ↑ |
| 8 | P | 20 | 40 | — | | — | 1.10 | — |
| 9 | P→N | 20 | 40 | 20 | RT | 0.38 | 1.07 | N' transfer amount ↑ |

Referring to Table 1, it can be seen that when the organic acid is located upstream relative to the nicotine freebase, the transfer amount of the nicotine salt is improved. Specifically, when experiment data nos. 3 and 4, and experiment data nos. 7 and 9 are compared, it can be seen that the nicotine salt transfer amount when the first portion 210 in which the organic acid is sorbed is located upstream and the second portion 220 in which the nicotine freebase is sorbed is located downstream (corresponding to experiment data nos. 4 and 9) is two to three times greater compared to when the first portion 210 is located downstream and the second portion 220 is located upstream (corresponding to experiment data nos. 3 and 7).

In an embodiment, the first portion 210 may extend from an end of the aerosol generating article 200 to a portion of about 8 mm to about 14 mm, the second portion 220 may extend from a point where the first portion 210 ends to a portion of about 8 mm to 14 mm, the third portion 230 may extend from a point where the second portion 220 ends to a portion of about 10 mm to 16 mm, and the fourth portion 240 may extend from a point where the third portion 230 ends to a portion of about 10 mm to 16 mm. However, the present disclosure is not limited to the numerical range, and lengths to which the first portion 210 and the second portion 220 extend may be appropriately adjusted within a range that may be easily changed by one of ordinary skill in the art.

Referring to FIG. 2, the first portion 210 and the second portion 220 may be positioned in parallel, and the third portion 230 and the fourth portion 240 may be arranged sequentially in the longitudinal direction of the aerosol generating article 200.

According to another embodiment, the first portion 210 and the second portion 220 may occupy approximately ½ of a cross section perpendicular to the longitudinal direction of the aerosol generating article 200, and at the same time, the first portion 210 and the second portion 220 may extend from an end of the aerosol generating article 200 to a portion of about 8 mm to about 14 mm, the third portion 230 may extend from a point where the first portion 210 and the second portion 220 ends to a portion of about 10 mm to 16 mm, and the fourth portion 240 may extend from a point where the third portion 230 ends to a portion of about 10 mm to 16 mm. However, the present disclosure is not limited to such a numerical range, and the proportion each of the first portion 210 and the second portion 220 occupies the cross section of the aerosol generating article 200 may be adjusted appropriately within a range easily adjustable by one of ordinary skill in the art.

When the first portion 210 and the second portion 220 of the aerosol generating article 200 are positioned in parallel, crushing a capsule including the organic acid and/or the nicotine freebase may become easier. In addition, because the first portion 210 and the second portion 220 have the same length, the first portion 210 and the second portion 220 may be heated more equally.

The aerosol generating article 200 may further include a material for heating 250. The material for heating may be a metal wrapper surrounding at least part of at least one of the first portion 210 and the second portion 220. The material for heating 250 may be heated by the heating element of the aerosol generating device, and the heated material for heating 250 may transfer heat to at least part of the first portion 210 and the second portion 220.

The heating temperature of the material for heating 250 may be about 150° C. to about 250° C. The heating temperature may be an average temperature calculated from the whole portion of the material for heating 250, not the temperature of a certain portion of the material for heating 250.

When the material for heating 250 surrounds only part of the first portion 210 and the second portion 220, the aerosol generating article 200 may include an unheated portion that is not heated. The unheated portion may refer to, for example, a portion in the first portion 210 and the second portion 220 not surrounded by the material for heating 250.

Because the aerosol generating article 200 includes an unheated portion, the first portion 210 and/or the second portion 220 of the aerosol generating article 200 may be gradually heated. That is, because a portion to which heat is not directly transferred by the material for heating 250 is heated after a portion to which heat is directly transferred by the material for heating 250 is consumed, gradual heating may prevent excessive decrease of possible smoking time of the aerosol generating article 200 due to sudden consumption of nicotine material included in the aerosol generating article 200.

Further, the material for heating 250 may surround at least part of the first portion 210 and at least part of the second portion 220 to bind the first portion 210 and the second portion 220. For example, the material for heating 250 may extend about 6 mm in both directions from the boundary of the first portion 210 and the second portion 220, and may surround part of the outer circumferential surface of the first portion 210 and the second portion 220 to bind the first portion 210 and the second portion 220. A metal wrapper may reinforce a tipping wrapper packing the aerosol generating article 200, thereby improving a coupling force of the first portion 210 and the second portion 220.

The form in which the material for heating 250 surrounds the aerosol generating article 200 is not limited to the example described above, and the rate or dimension of the material for heating 250 surrounding the first portion 210 and/or the second portion 220 may be determined arbitrarily. For example, when the first portion 210 and the second portion 220 are positioned in parallel, dimensions of the material for heating 250 in a longitudinal direction and in directions transverse to the longitudinal direction may be determined such that the material for heating 250 wraps about 30% of the outer circumferential surface of the first portion 210 and wraps about 50% of the outer circumferential surface of the second portion 220.

The material for heating 250 may not only be a thermally conductive material that may be heated by receiving heat from the heating element, but also be an electrically conductive material that may be heated by a variable magnetic field. Specifically, the material for heating 250, which is an electrically conductive material, may be heated by an eddy current loss and/or a hysteresis loss induced by a variable magnetic field. For example, the material for heating 250 may be a metal wrapper, specifically, an aluminum foil.

At least one of the first portion 210 and the second portion 220 may include a moisturizer. The moisturizer may be impregnated with the crimped paper together with at least one of the organic acid and the nicotine salt by being applied to the crimped paper. The moisturizer may include at least one of, for example, glycerin, propylene glycol, ethylene glycol, dipropylene glycol, diethylene glycol, triethylene glycol, tetraethylene glycol, and oleyl alcohol.

Specifically, the moisturizer may be a combination of glycerin and propylene glycol. Specifically, glycerin and propylene glycol may be combined in a ratio of about 9:1 to about 6:4.

For example, the moisturizer may be generated by combining glycerin and propylene glycol in a certain ratio based on 100%. Specifically, glycerin and propylene glycol may be combined at a ratio of 9:1, 8.5:1, 8:2, 7:3, and 6:4. The ratio may correspond to a weight ratio or a volume ratio. However, the present disclosure is not limited thereto, and the moisturizer may include only glycerin.

The third portion 230 may cool an airflow passing through the first portion 210 and the second portion 220. The third portion 230 may be made of a polymer material or a biodegradable polymer material and may have a cooling function. For example, the third portion 230 may be made of a polylactic (PLA) fiber, but is not limited thereto. Alternatively, the third portion 230 may be made of a cellulose acetate filter having a plurality of holes. However, the third portion 230 is not limited to the above-described example, and a material having a function of cooling an aerosol may be used for the third portion 130 without limitation. For example, the third portion 230 may be a tube filter or a paper sleeve including a hollow therein.

The fourth portion 240 may include a filter material. For example, the fourth portion 240 may be a cellulose acetate filter. The shape of the fourth portion 240 is not limited. For example, the fourth portion 240 may be a cylindrical rod or a tube-type rod including a hollow therein. In addition, the fourth portion 240 may be a recess-type rod. When the fourth portion 240 includes a plurality of segments, at least one of the plurality of segments may have a different shape from the others.

The fourth portion 240 may also be made to generate flavor. In an example, a flavoring liquid may be sprayed on the fourth portion 240, or a separate fiber coated with the flavoring liquid may be inserted into the fourth portion 240.

In addition, a crushable capsule containing an organic acid may be included in the fourth portion 240.

The aerosol generating article 200 may include a tipping wrapper surrounding at least part of the first portion 210 to the fourth portion 240. In addition, the aerosol generating article 200 may include a tipping wrapper surrounding all of the first portion 210 to the fourth portion 240. The tipping wrapper may be located on the outer periphery of the aerosol generating article 200, and may have at least one hole through which external air may be introduced or internal air may be discharged. The tipping wrapper may be a single wrapper but may be a combination of a plurality of wrappers.

For example, the first portion 210 of the aerosol generating article 200 may include a crimped wrinkled sheet containing an aerosol generating material, the second portion 220 may include a cigarette sheet containing a cigarette material and continuously extending in length, the third portion 230 may include a cooling portion, and the fourth portion 240 may include a filter material, but the present disclosure is not limited thereto.

Figure 3A:
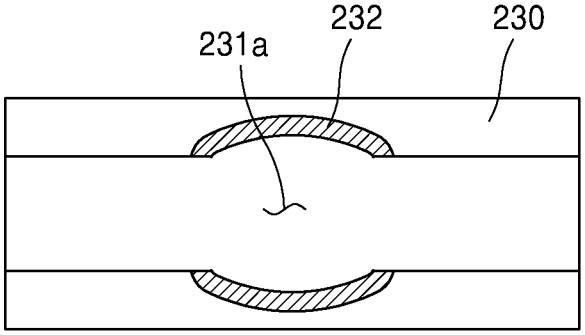
FIG. 3A is a longitudinal cross-sectional view of a third portion of an aerosol generating article according to an embodiment.
Figure 3B:
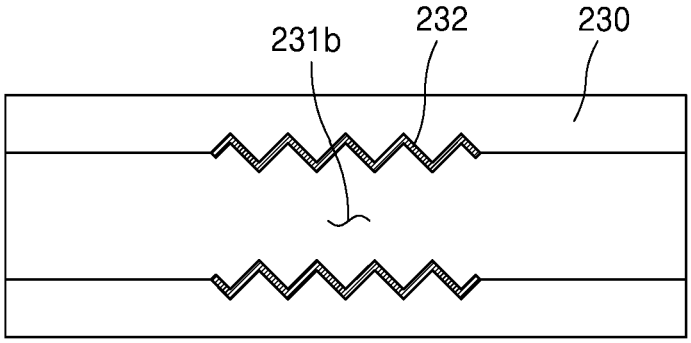
FIG. 3B is a longitudinal cross-sectional view of a third portion of an aerosol generating article according to another embodiment.

FIG. 3A is a longitudinal cross-sectional view of the third portion of an aerosol generating article according to an embodiment, and FIG. 3B is a longitudinal cross-sectional view of the third portion of an aerosol generating article according to another embodiment.

Referring to FIGS. 3A and 3B, as described above, the third portion 230 may cool the airflow passing through the first portion and the second portion, and may be a tube filter or a paper sleeve including a hollow therein.

According to some embodiments, the third portion 230 may include acid-base reaction spaces 231*a* and 231*b*. The acid-base reaction spaces 231*a* and 231*b* may provide a space in which the organic acid and nicotine freebase in the form of vapor or an aerosol generated in the first portion and the second portion are easily mixed.

According to an embodiment, the acid-base reaction space 231*a* may be a space in which a cavity is included in at least part of the third portion 230 in the longitudinal direction thereof. The cavity may be a roughly spherical space having a radius greater than the hollow of the third portion 230. Because the radius of the cavity is greater than that of the hollow, the speed of the airflow passing through the third portion 230 may be lowered, and thus, the reaction of generating nicotine salt may be sufficiently performed before the airflow is flown into the user's mouth.

According to another embodiment, the acid-base reaction space 231*a* may be a space in which an unevenness having a screw thread shape is included in at least part of the third portion 230 in the longitudinal direction thereof. The unevenness may provide a fluid resistance to the airflow passing through the third portion 230 to lower the speed of the airflow passing through the third portion 230, and may induce the formation of eddy currents so that the nicotine freebase and the organic acid are mixed. Accordingly, the reaction of generating the nicotine salt may be sufficiently performed before the airflow is flown into the user's mouth. The unevenness having a screw thread shape is only an example, and various shapes of unevenness capable of providing fluid resistance to the airflow may be included in the acid-base reaction space 231*b*.

Further, the third portion 230 may include an absorbent material 232. The absorbent material 232 may absorb moisture generated according to the acid-base reaction of the organic acid and the nicotine freebase, thereby preventing the aerosol generated from the aerosol generating article from containing more moisture than necessary.

According to some embodiments, the absorbent material 232 may be located on the inner surface of the acid-base reaction spaces 231*a* and 231*b*. In addition, the absorbent material 232 may be located on the surface of the hollow of the third portion 230. Accordingly, the moisture generated by the continuous acid-base reactions along the airflow may be absorbed in the inner surface of the third portion 230.

Figure 4A:
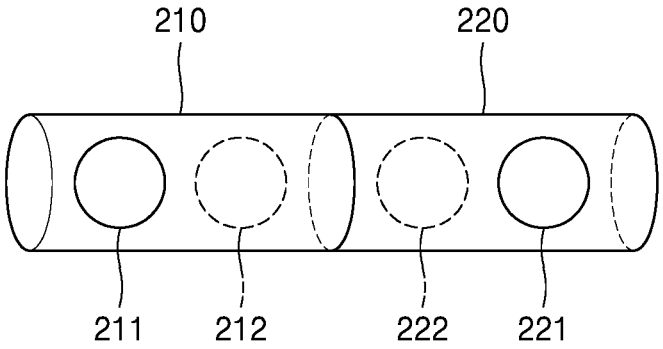
FIG. 4A is a view of configurations of a first portion and a second portion of an aerosol generating article according to an embodiment.
Figure 4B:
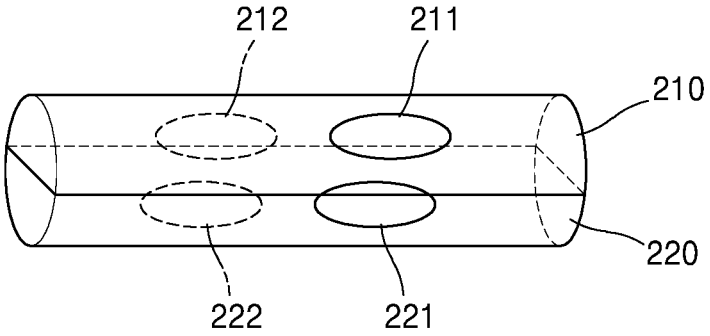
FIG. 4B is a view of configurations of a first portion and a second portion of an aerosol generating article according to another embodiment.

FIG. 4A is a diagram illustrating configurations the first portion and the second portion of the aerosol generating article according to an embodiment, and FIG. 4B is a diagram illustrating configurations of the first portion and the second portion of the aerosol generating article according to another embodiment.

The first portion 210 may include crushable capsules 211 and 212 including a crimped paper and an organic acid. Similar to the first portion 210, the second portion 220 may also include crushable capsules 221 and 222 including a crimped paper and an organic acid.

Because at least one of the organic acid and the nicotine freebase is not impregnated with the crimped paper and is included in the capsules 211, 212, 221, and 222, the crimped paper may be included in the aerosol generating article in a dry state, and at least one of the organic acid and the nicotine freebase may be prevented from permeating into the tipping wrapper surrounding the first portion 210 and/or the second portion 220. Accordingly, at least one of the first portion 210 and the second portion 220 may be wrapped with even a thin tipping wrapper. In addition, a dry tipping wrapper may provide a higher strength than a humid tipping wrapper, and thus a solid aerosol generating article may be manufactured.

According to an embodiment, the capsules 211 and 221 may be crushed by an external force. For example, the capsules 211 and 221 may be crushed when the user bites or applies pressure by hand to the capsules 211 and 221 before inserting the aerosol generating article into the aerosol generating device.

According to another embodiment, the capsules 212 and 222 may be crushed by heat. For example, the capsules 212 and 222 may be crushed by receiving heat from the heating element and/or the material for heating of the aerosol generating device.

According to another embodiment, the capsules 212 and 222 may be crushed by pressure or heat.

The organic acid and/or the nicotine freebase flown out from the crushed capsule may be impregnated with the crimped paper, and as the first portion 210 and/or the second portion 220 is heated, may be phase-changed to vapor.

Referring to FIG. 4A, the capsules 211, 212, 222, and 221 may be a sphere shape. In addition, because the capsules 212 and 222 crushed by heat are located adjacent to each other, a similar amount of heat may be transferred to the first portion 210 and the second portion 220, and when the aerosol generating article is heated, the capsule 212 crushed by heat in the first portion 210 and the capsule 222 crushed by heat in the second portion 220 may be crushed practically at the same time.

Referring to FIG. 4B, the capsules 211, 212, 222, and 221 may be an elliptical (oval) shape. In addition, because the first portion 210 and the second portion 220 are positioned in parallel, the capsules 211 and 221 that are crushed by external force may also be positioned in parallel, and when pressure is applied to the aerosol generating article, the capsule 211 that is crushed by external force in the first portion 210 and the capsule 221 that is crushed by external force in the second portion 220 may be crushed practically at the same time.

Figure 5:
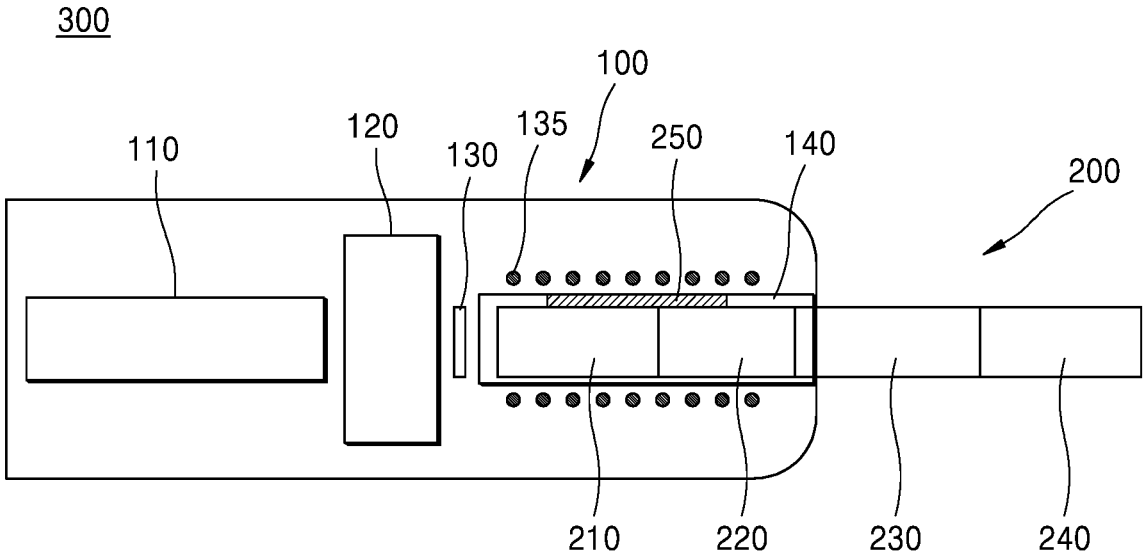
FIG. 5 is a view showing an example in which the aerosol generating article is inserted into an aerosol generating device.

FIG. 5 is a diagram showing an example in which the aerosol generating article is inserted into the aerosol generating device.

Referring to FIG. 5, the aerosol generating device 100 may include an accommodating space 140 accommodating the aerosol generating article 200, a heating element 130 for heating the aerosol generating article 200, a processor 120 for controlling the operation of the heating element 130, and a battery 110 for supplying power to the processor 120 and the heating element 130. Further, the aerosol generating device 100 may further include a vaporizer (not shown). The aerosol generating article 200 may be inserted into the accommodating space 140 of the aerosol generating device 100 to form an aerosol generating system 300.

The aerosol generating device 100 shown in FIG. 5 shows components related to the present embodiment. Accordingly, it may be understood by one of ordinary skill in the art related to the present embodiment that the aerosol generating device 100 may further include other general-purpose components in addition to the components shown in FIG. 5.

FIG. 5 illustrates that the battery 110, the processor 120, and the heating element 130 are arranged in a row. However, the internal structure of the aerosol generating device 100 is not limited to the structures illustrated in FIG. 5. In other words, the arrangement of the battery 110, the processor 120, and the heating element 130 may be changed according to the design of the aerosol generating device 100.

When the aerosol generating article 200 is inserted into the aerosol generating device 100, the aerosol generating device 100 may operate the heating element 130 to generate aerosol from the aerosol generating article 200. The aerosol generated from the heating element 130 may pass through the aerosol generating article 200 to be transferred to the user.

As necessary, even when the aerosol generating article 200 is not inserted into the aerosol generating device 100, the aerosol generating device 100 may heat the heating element 130.

The battery 110 may supply power to be used for the aerosol generating device 100 to operate. For example, the battery 110 may supply power to heat the heating element 130, and may supply power for operating the processor 120. Also, the battery 110 may supply power for operating a display, a sensor, a motor, etc. installed in the aerosol generating device 100.

The processor 120 may generally control an operation of the aerosol generating device 100. Specifically, the processor 120 may control not only operations of the battery 110, the heating element 130, and the vaporizer, but also operations of other components included in the aerosol generating device 100. In addition, the processor 120 may also determine whether or not the aerosol generating device 100 is in an operable state by checking the state of each component of the aerosol generating device 100.

The processor 120 may include at least one processor. The processor may be implemented as an array of a plurality of logic gates or may be implemented as a combination of a general-purpose microprocessor and a memory in which a program executable in the microprocessor is stored. In addition, those skilled in the art related to the present embodiment may understand that the processor may consist of other types of hardware.

The heating element 130 may be heated by the power supplied from the battery 110. For example, when the aerosol generating article 200 is inserted into the aerosol generating device 100, the heating element 130 may be located outside the aerosol generating article 200. Therefore, the heated heating element 130 may raise the temperature of the aerosol generating material in the aerosol generating article 200.

The heating element 130 may include an electrically resistive heater. For example, the heating element 130 may include an electrically conductive track, and the heating element 130 may be heated when currents flow through the electrically conductive track. However, the heating element 130 is not limited to the above-described example and may be applicable without limitation as long as it can be heated to a desired temperature. The desired temperature may be preset in the aerosol generating device 100 or may be set by a user.

As another example, the heating element 130 may be an induction heating type heating element. Specifically, the heating element 130 may include an electrically conductive coil 135 for heating the aerosol generating article 200 in an induction heating method, and the aerosol generating article 200 may include a susceptor that may be heated by an induction heating type heating element.

The susceptor may correspond to the material for heating 250 that is heated by a variable magnetic field generated in the electrically conductive coil 135, and the material for heating 250 may be a metal wrapper surrounding at least part of the aerosol generating article 200 to transfer heat to the aerosol generating article 200. That is, the aerosol generating device 100 including the electrically conductive coil 135 may be an induction heating type aerosol generating device 100 that forms a variable magnetic field and heats the material for heating 250.

In addition, the heating element 130 may include a tube-type heating element, a plate-type heating element, a needle-type heating element, a plane coil type heating element, a three-dimensional coil type heating element, or a rod-type heating element, and the inside or outside of aerosol generating article 200 may be heated according to the shape of the heating element.

In addition, a plurality of heating elements 130 may be arranged in the aerosol generating device 100. In this state, the plurality of heating elements 130 may be inserted into the aerosol generating article 200 or may be arranged outside the aerosol generating article 200. In addition, some of the plurality of heating elements 130 may be inserted into the aerosol generating article 200 and the others may be arranged outside the aerosol generating article 200. In addition, the shape of the heating elements 130 is not limited to the shape shown in FIG. 5 and may be manufactured in various shapes.

The aerosol generating device 100 may further include other general-purpose components in addition to the battery 110, the processor 120, the heating element 130, the accommodating space 140, and the vaporizer. For example, the aerosol generating device 100 may include a display capable of outputting visual information and/or a motor for outputting tactile information.

In addition, the aerosol generating device 100 may include at least one sensor (a puff detecting sensor, a temperature detecting sensor, an aerosol generating article insertion detecting sensor, etc.). In addition, the aerosol generating device 100 may be formed as a structure that, even when the aerosol generating article 200 is inserted into the aerosol generating device 100, may introduce external air or discharge internal air.

Although not shown in FIG. 5, the aerosol generating device 100 may constitute a system together with a separate cradle. For example, the cradle may be used to charge the battery 110 of the aerosol generating device 100. Alternatively, the heating element 130 may also be heated in a state in which the cradle and the aerosol generating device 100 are coupled to each other.

The first portion 210 and the second portion 220 of the aerosol generating article 200 are inserted into the aerosol generating device 100, and the third portion 230 and the fourth portion 240 may be exposed to the outside. Further, the first portion 210 of the aerosol generating article 200 may be inserted into the aerosol generating device 100, and a portion of the second portion 220 may be inserted thereinto. The user may inhale the aerosol while holding the fourth portion 240 by the mouth. In this state, the aerosol may be generated by the external air passing through the first portion 210 and the second portion 220, and the generated aerosol may pass through the third portion 230 and the fourth portion 240 and delivered to the user's mouth.

For example, the external air may flow into at least one air passage formed in the aerosol generating device 100. For example, opening and closing and/or a size of the air passage formed in the aerosol generating device 100 may be adjusted by a user. Accordingly, the amount of atomization, smoking feeling, and the like may be adjusted by the user. As another example, the external air may flow into the aerosol generating article 200 through at least one hole formed in a surface of the aerosol generating article 200.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating article comprising:
- a first portion including an organic acid;
- a second portion including a nicotine freebase;
- a third portion including a cooling material; and
- a fourth portion including a filter material, wherein a nicotine salt is generated through an acid-base reaction of the organic acid of the first portion and the nicotine freebase of the second portion that are vaporized by heating,
- wherein the third portion includes an acid-base reaction space, and
- wherein the acid-base reaction space is a space in which a cavity is included in at least part of the third portion in a longitudinal direction thereof, the cavity being a spherical space having a radius greater than a hollow of the third portion.

2. The aerosol generating article of claim 1, wherein the first portion, the second portion, the third portion, and the fourth portion are arranged sequentially in a longitudinal direction of the aerosol generating article.

3. The aerosol generating article of claim 1, wherein the first portion and the second portion are positioned in parallel, and the third portion and the fourth portion are arranged sequentially in a longitudinal direction of the aerosol generating article.

4. The aerosol generating article of claim 1, wherein the third portion includes an absorbent material.

5. The aerosol generating article of claim 1, wherein at least one of the organic acid and the nicotine freebase is included in a capsule crushable by an external force and/or heat.

6. The aerosol generating article of claim 1, wherein at least one of the first portion and the second portion includes a moisturizer.

7. The aerosol generating article of claim 6, wherein the moisturizer includes propylene glycol and glycerin.

8. The aerosol generating article of claim 1, further comprising a material for heating, wherein:
- the material for heating includes a metal wrapper surrounding at least part of at least one of the first portion and the second portion, and
- the material for heating is heated to transfer heat to the organic acid and the nicotine freebase.

9. The aerosol generating article of claim 8, wherein the material for heating surrounds at least part of the first portion and at least part of the second portion and binds the first portion to the second portion.

10. The aerosol generating article of claim 8, wherein the material for heating is heated by a variable magnetic field.

11. An aerosol generating system comprising:
- an aerosol generating article according to claim 1; and
- an aerosol generating device, wherein the aerosol generating device includes:
  - an accommodating space accommodating the aerosol generating article,
  - a heating element configured to heat the aerosol generating article,
  - a processor configured to control an operation of the heating element, and
  - a battery configured to supply power to the processor and the heating element.

12. The aerosol generating system of claim 11, wherein:
- the aerosol generating article further comprises a material for heating, and the heating element generates a variable magnetic field to heat the material for heating.

* * * * *